US009206981B2

(12) United States Patent
Naumann

(10) Patent No.: US 9,206,981 B2
(45) Date of Patent: Dec. 8, 2015

(54) GAS VALVE UNIT COMPRISING AN ACTUATION MECHANISM FOR A SOLENOID VALVE

(75) Inventor: Jörn Naumann, Durbach (DE)

(73) Assignee: BSH Hausgeraete GmbH, Munich (DE)

( * ) Notice: Subject to any disclaimer, the term of this patent is extended or adjusted under 35 U.S.C. 154(b) by 281 days.

(21) Appl. No.: 13/989,432

(22) PCT Filed: Dec. 7, 2011

(86) PCT No.: PCT/EP2011/072059
§ 371 (c)(1),
(2), (4) Date: May 24, 2013

(87) PCT Pub. No.: WO2012/080055
PCT Pub. Date: Jun. 21, 2012

(65) Prior Publication Data

US 2013/0240767 A1 Sep. 19, 2013

(30) Foreign Application Priority Data

Dec. 14, 2010 (EP) ..... 10290654

(51) Int. Cl.
*F23K 1/00* (2006.01)
*F23N 1/00* (2006.01)
*F23K 5/00* (2006.01)

(52) U.S. Cl.
CPC ..... *F23N 1/007* (2013.01); *F23K 5/007* (2013.01); *F23K 2900/05001* (2013.01); *F23N 2035/18* (2013.01); *F23N 2035/22* (2013.01); *F23N 2035/24* (2013.01); *F23N 2037/10* (2013.01); *F23N 2041/08* (2013.01)

(58) Field of Classification Search
CPC . F23N 1/007; F23N 2037/10; F23N 2035/16; F23N 2035/24; F23N 2035/22; F23N 2035/18; F23N 2041/08; F23K 5/007; F23K 2900/05001
USPC ..... 251/251, 262–263, 337
See application file for complete search history.

(56) References Cited

U.S. PATENT DOCUMENTS 5,295,476 A * 3/1994 Herbert ..... 126/39 G
5,979,484 A * 11/1999 Grando et al. ..... 137/66
2006/0166154 A1 7/2006 Park

FOREIGN PATENT DOCUMENTS

DE 1429062 A1 10/1968
DE 1529057 B1 6/1972
EP 0 486 796 A1 * 5/1992
EP 0492057 A1 7/1992

(Continued)

OTHER PUBLICATIONS

International Search Report PCT/EP2011/072059 dated Aug. 7, 2013.

*Primary Examiner* — John Bastianelli
(74) *Attorney, Agent, or Firm* — James E. Howard; Andre Pallapies

(57) ABSTRACT

A gas valve unit for setting a gas volume flow supplied to a gas burner of a gas appliance includes a valve housing, an actuation pin for setting an opening cross section of the gas valve unit, a shutoff valve, and a linearly displaceable connecting element for transferring a movement of the actuation pin to the shutoff valve. The connecting element has at least one spring which can be embodied as a compression spring or as a coil spring.

16 Claims, 5 Drawing Sheets

(56) References Cited

FOREIGN PATENT DOCUMENTS

| | | | |
|---|---|---|---|
| EP | 1672279 | A1 | 6/2006 |
| GB | 2196732 | A | 5/1988 |
| GB | 2242257 | A | 9/1991 |
| WO | 0111278 | A1 | 2/2001 |

* cited by examiner

GAS VALVE UNIT COMPRISING AN ACTUATION MECHANISM FOR A SOLENOID VALVE

BACKGROUND OF THE INVENTION

The invention relates to a gas valve unit for setting a gas volume flow supplied to a gas burner of a gas appliance, in particular a gas cooker, the gas valve unit having a valve housing and an actuation pin for setting an opening cross section of the gas valve unit and an additional shutoff valve, and a movement of the actuation pin being able to be transferred to the shutoff valve by means of a linearly displaceable connecting element.

Gas valves of the type mentioned with a shutoff valve are frequently referred to as safe gas valves. A knob is generally positioned on an operating segment of the gas valve unit and can be accessed manually by an operator of the gas cooker. The opening cross section of the gas valve unit is generally set by rotating the actuation pin. The shutoff valve can be opened by the operator by axially displacing the actuation pin by pushing on the knob.

The axial movement of the actuation pin is transferred to a linearly displaceable connecting element. This transfer of the movement of the actuation pin to the connecting element can take place directly or indirectly, for example by way of a facility for deflecting the movement direction. The connecting element is in direct or indirect contact with a shutoff element of the shutoff valve. An axial movement of the connecting element in the direction of the shutoff element allows the latter to be raised from a valve seat, thereby opening the shutoff valve.

The shutoff valve generally also has a magnetic unit, which can hold the shutoff element in the open position, when the shutoff element has been moved into this open position manually by pushing the valve pin. The magnetic force that can be generated with the magnetic unit is however not of sufficient size to move the shutoff element from its closed position to the open position. The magnetic unit generally contains a wound coil, which is connected to a thermocouple disposed in the region of a gas burner. The electric voltage generated with the thermocouple brings about a current flow through the coil of the magnetic unit, thereby generating a magnetic force which holds the shutoff valve open, while a gas flame is burning at the gas burner. When the gas flame is extinguished, the shutoff valve closes automatically and can only be opened again manually by pushing the actuation pin.

Gas valve units of the prior art have the problem that pushing the actuation pin allows the shutoff element to be moved in the opening direction until it comes up against the magnetic unit. If the actuation pin is pushed in with great force, it can cause the shutoff element to change shape, which may impair the function of the shutoff valve. In particular it is possible that the magnetic unit can no longer hold the shutoff element with its changed shape in the open position because there is too great an air gap between the shutoff element and the magnetic unit due to the shape change.

BRIEF SUMMARY OF THE INVENTION

The object of the present invention is to provide a gas valve unit, in which the function of the shutoff valve is permanently ensured.

According to the invention this object is achieved in that the connecting element has at least one spring. When a particularly large force is applied to the connecting element, the spring yields, thereby preventing damage to components of the shutoff valve. At the same time the spring is designed so that normal actuation forces are transferred by the spring. The spring ensures that when an operator pushes the actuation pin, the shutoff valve is opened so far that the shutoff element can then be held open automatically, for example by means of a magnetic unit supplied with power by a thermocouple. A "spring" in the present context refers to any element that changes shape and/or length as a function of force, regardless of the material and/or shape of the element. Wound metal springs or injection molded plastic springs can be used for example.

It is expedient if the connecting element is suitable for transferring pressure forces. The term "pressure force" here refers to a force that acts in a linear manner.

The spring of the connecting element is expediently embodied as a compression spring. The compression spring changes length when a linear force acts.

It is also advantageous for the spring of the connecting element to be embodied as a coil spring.

The coil spring preferably has a constant or varying winding radius. In the case of a constant winding radius the coil spring has a cylindrical shape. The diameter of the coil spring is constant over the length of the spring. In the case of a coil spring with varying winding radius the winding radius changes over the length of the coil spring so that the coil spring has a smaller diameter at one point than at another point at an axial distance from the first point.

The connecting element is expediently passed through the valve housing in a region where the coil spring has the maximum winding radius. In the case of coil springs with constant winding radius the entire length of the coil spring is the region with the maximum winding radius. The region with the maximum winding radius is generally the widest point of the connecting element.

The shutoff element is pretensioned into a closed position by means of a closing spring. This ensures that the shutoff valve is always closed in the rest position. By pushing the actuation pin manually it is possible to open the shutoff valve counter to the force of the closing spring. In the closed position the shutoff element rests against a valve seat of the shutoff valve, thereby preventing the flow of gas through the gas valve unit.

A spring constant of the spring of the connecting element is advantageously greater than a spring constant of the closing spring. Pushing the actuation pin therefore first causes the closing spring to compress and therefore the shutoff valve to open. Only when the shutoff valve has been opened to the maximum and the shutoff element is resting against an end stop does the force acting on the connecting element increase, thereby causing the spring of the connecting element to compress further. The maximum force acting on the shutoff element is therefore limited by the spring of the connecting element.

According to one expedient embodiment of the invention a deflection apparatus is provided, which converts an axial movement of the actuation pin to an axial movement of the connecting element essentially at right angles thereto. Such a deflection apparatus is necessary in particular when the size of the gas valve unit is limited in the longitudinal direction of the actuation pin.

The deflection apparatus has a first slide element, which is disposed on the actuation pin in the region of the end of the actuation pin opposite the operating segment. The operating segment of the actuation pin is the segment on which a knob for example can be positioned. The end of the actuation pin opposite the operating segment is in the interior of the housing of the gas valve unit.

The first slide element is preferably embodied as a first conical element so that a tip of the first conical element points away from the operating segment of the actuation pin. The embodiment of the slide element as a conical element has the advantage that the spatial extension of the slide element is not a function of the rotation position of the actuation pin.

The deflection apparatus has a second slide element, which is in contact with the first slide element at least when the actuation pin is pushed.

The second slide element is configured as a second conical element, the center axis of which is disposed essentially perpendicular to the actuation pin and the tip of which points in the direction of the first slide element. When the first slide element is displaced axially, the two slide elements slide down along one another and the second slide element is displaced in the axial direction of the second slide element.

The second slide element is preferably disposed at the end of the connecting element facing the actuation pin. Axial movement of the second slide element therefore automatically brings about axial movement of the connecting element.

The connecting element preferably has at least one segment in which a spring wire is aligned parallel to a movement direction of the connecting element. In this segment the spring wire is loaded in the longitudinal direction and therefore has no spring force in the loading direction. It is a segment of the same spring wire from which the coil spring is also configured.

The second slide element is particularly advantageously attached to the spring wire, preferably to the segment of the spring wire parallel to the movement direction of the connecting element.

According to one particularly advantageous embodiment the gas valve unit for setting the opening cross section has at least two on-off valves and at least two throttle points, each having at least one throttle opening, through which gas can flow as a function of the switching position of the on-off valves. The opening cross section is therefore set by opening and closing the on-off valves in a specific manner. This is done by rotating the actuation pin. A permanent magnet for example can be provided to open and close the on-off valves, being moved over the on-off valves. The on-off valve directly in the region of the permanent magnet is opened by magnetic force in each instance. In contrast the shutoff valve is opened by means of a mechanical force by pushing the actuation pin. It can then be held open by means of an electromagnetic force, for example as a result of the voltage generated by a thermocouple to monitor the flame.

BRIEF DESCRIPTION OF THE DRAWINGS

Further advantages and details of the invention are described in more detail with reference to the exemplary embodiment illustrated in the schematic figures, in which.

DETAILED DESCRIPTION OF EXEMPLARY EMBODIMENTS OF THE PRESENT INVENTION

Figure 1:
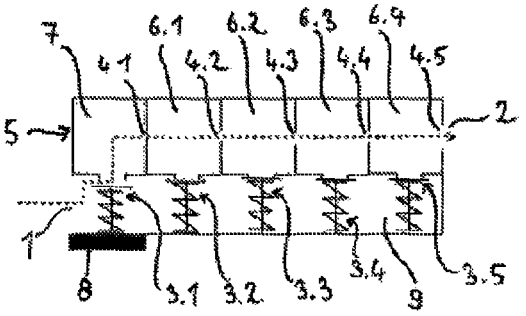
FIG. 1 shows a schematic switching arrangement of the on-off valves and the throttle points with a first on-off valve opened.
Figure 2:
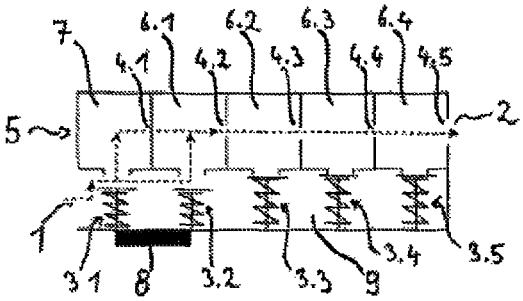
FIG. 2 shows the schematic switching arrangement with two on-off valves opened.
Figure 3:
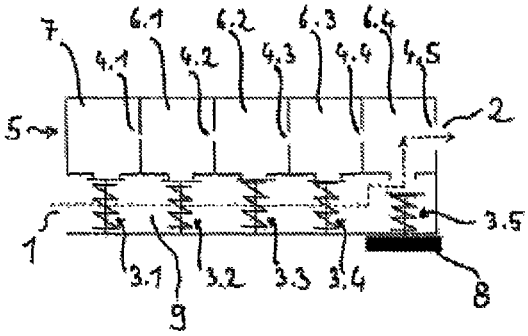
FIG. 3 shows the schematic switching arrangement with the last on-off valve opened.

FIGS. 1 to 3 show the switching arrangement of the on-off valves 3 (3.1 to 3.5) and the throttle points 4 (4.1 to 4.5) of the gas valve unit. The inventive shutoff valve and the connecting element are however not shown here.

A gas inlet 1 is shown, by way of which the gas valve unit is connected for example to a main gas line of a gas cooker. The gas provided for combustion is present at the gas inlet 1 with a constant pressure of for example 20 millibars or 50 millibars. Connected to a gas outlet 2 of the gas valve unit is a gas line, which leads for example to a gas burner of the gas cooker. The gas inlet 1 is connected by way of a gas inlet chamber 9 of the gas valve unit to the inlet side of the, in the present exemplary embodiment, five on-off valves 3 (3.1 to 3.5). Opening the on-off valves 3 connects the gas inlet 1 in each instance to a specified segment of a throttle section 5, into which the gas flows by way of the opened on-off valve 3. The throttle section 5 comprises an inlet segment 7, into which the first on-off valve 3.1 opens. The further on-off valves 3.2 to 3.5 open respectively into a connecting segment 6 (6.1 to 6.4) of the throttle section 5. The transition between the inlet segment 7 and the first connecting segment 6.1 and the transitions between two adjacent connecting segments 6.1 to 6.4 are formed respectively by a throttle point 4 (4.1 to 4.5). The last throttle point 4.5 connects the last connecting segment 6.4 to the gas outlet 2. The throttle points 4.1 to 4.5 have an opening cross section that increases along the row. The throughflow cross section of the last throttle point 4.5 can be selected to be of such size that the last throttle point 4.5 has practically no throttle function.

The on-off valves 3 are actuated by means of a permanent magnet 8, which can be displaced along the row of on-off valves 3. The force for opening the respective on-off valve 3 is formed here directly by the magnetic force of the permanent magnet 8. This magnetic force opens the respective on-off valve 3 counter to a spring force.

In the switching position according to FIG. 1 only the first on-off valve 3.1 is opened. Gas flows through this on-off valve 3.1 from the gas inlet chamber 9 into the inlet segment 7, passing through all the throttle points 4 and all the connecting segments 6 from there on the path to the gas outlet 2. The quantity of gas flowing through the valve unit predetermines the minimum output of the gas burner connected to the gas valve unit.

FIG. 2 shows the schematic switching arrangement, in which the permanent magnet 8 is displaced to the right in the drawing so that both the first on-off valve 3.1 and the second on-off valve 3.2 are opened.

The gas flows through the opened second on-off valve 3.2 from the gas inlet chamber 9 directly into the first connecting segment 6.1 and from there by way of the throttle points 4.2 to 4.5 to the gas outlet 2. The gas flowing to the gas outlet 2 bypasses the first throttle point 4.1 due to the opened on-off valve 3.2. The gas volume flow in the switching position according to FIG. 2 is therefore greater than the gas volume flow in the switching position according to FIG. 1. The gas flows to the first connecting segment 6.1 almost exclusively by way of the second on-off valve 3.2. The open on-off valves 3.1 and 3.2 mean the same pressure level prevails in the inlet segment 7 as in the first connecting segment 6.1. Therefore virtually no gas flows out of the inlet segment 7 by way of the first throttle point 4.1 into the first connecting segment 6.1. The gas volume flow flowing overall through the gas valve unit does not therefore change to any degree, when the permanent magnet 8 is moved further to the right in the drawing, thereby closing the first on-off valve 3.1 while the second on-off valve 3.2 remains open.

Moving the permanent magnet 8 to the right in the drawing causes the on-off valves 3.3 to 3.5 to be successively opened, thereby increasing the gas volume flow through the gas valve unit in steps.

FIG. 3 shows the schematic switching arrangement of the gas valve unit in the maximum open position. Here the permanent magnet 8 is in its end position on the right side in the drawing. When the permanent magnet 8 is in this position, the last on-off valve 3.5 is opened. Gas flows directly out of the gas inlet chamber 9 into the last connecting segment 6.4, only passing through the last throttle point 4.5 on the path to the gas outlet 2. This last throttle point 4.5 can have a throughflow cross section of such size that there is practically no throttling of the gas flow and the gas can flow through the gas valve unit practically unthrottled.

Figure 4:
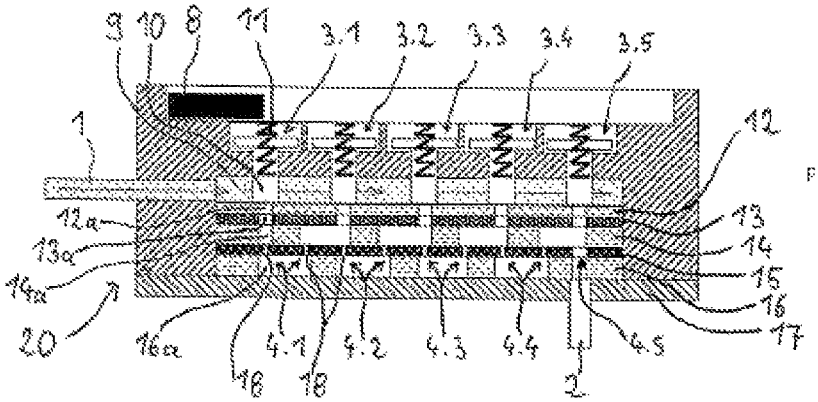
FIG. 4 shows a schematic structure of a gas valve arrangement with on-off valves closed.

FIG. 4 shows a schematic diagram of a structure of a gas valve unit with a switching arrangement according to FIGS. 1 to 3. The inventive shutoff valve is not shown again here.

FIG. 4 shows a valve body 20, in which the gas inlet 1 of the gas valve unit is embodied. Present in the interior of the valve body 20 is a gas inlet chamber 9 connected to the gas inlet 1. Shutoff bodies 10 of the on-off valves 3 are passed through the valve body 20 in such a manner that they can move up and down in the drawing. Each shutoff body 10 is pretensioned downward in the drawing by means of a spring 11. The force of the permanent magnet 8 allows each shutoff body 10 to be moved upward in the drawing counter to the force of the spring 11. The springs 11 push the shutoff bodies onto a valve sealing plate 12, so that the shutoff bodies 10 close off openings 12*a* present in the valve sealing plate 12 in a gas-tight manner. Disposed below the valve sealing plate 12 is a pressure plate 13 with openings 13*a* which correspond to the openings 12*a* in the valve sealing plate 12. The openings 13*a* in the pressure plate 13 open in openings 14*a* into a first gas distribution plate 14. Present below the first gas distribution plate 14 in the drawing is a throttle plate 15 with a plurality of throttle openings 18. Each of the throttle points 4.1 to 4.4 is formed by two throttle openings 18. The two throttle openings 18 associated with a throttle point 4.1 to 4.4 are connected respectively to one another by means of the openings 16*a* in a second gas distribution plate 16. The openings 14*a* in the first gas distribution plate in contrast connect the neighboring throttle openings 18 of two adjacent throttle points 4.1 to 4.5. The last throttle point 4.5 consists of just one throttle opening 18, which opens by way of a corresponding opening 16*a* in the second gas distribution plate 16 into the gas outlet 2 of the gas valve unit.

In the switching position according to FIG. 4 the permanent magnet 8 is in an end position, in which all the on-off valves 3 are closed. The gas valve unit is closed as a whole. The gas volume flow is equal to zero. From this switching position the permanent magnet 8 is moved to the right in the drawing, thereby opening each of the on-off valves 3 disposed below the permanent magnet 8.

FIGS. 5 to 8 show the schematic structure of the inventive gas valve arrangement. They show the connecting element 45 but not the spring associated with the connecting element 45. They show the essentially rotationally symmetrical valve housing 20 with a centrally disposed actuation pin 31. The, by way of example, five on-off valves 3 are disposed along an arc around the actuation pin 31. At the upper end of the actuation pin 31 is its operating segment 29, on which for example a knob can be positioned. Disposed at the lower end of the actuation pin 31 is an actuation apparatus 25, at the outer end of which the permanent magnet 8 is disposed. When the actuation pin 31 is rotated, the permanent magnet 8 moves along an arc past the on-off valves 3. The on-off valves 3 which are directly above the permanent magnet 8 are opened in each instance by the magnetic force of the permanent magnet 8. A knob that can be gripped directly by the operator for example can be positioned at the top of the actuation pin 31.

A cover 30 is configured on the upper face of the valve body, in which, from bottom to top, the valve sealing plate 12, the pressure plate 13, the first gas distribution plate 14, the throttle plate 15 and the second gas distribution plate 16 are disposed. The plates 12 to 16 can be accessed by removing the cover 30. Access to the plates 12 to 16 is from above, in other words from the same side from which the actuation pin 31 projects from the valve housing 20.

The throttle plate 15 in particular can be replaced to adapt the gas valve unit for a different type of gas. Present in the throttle plate 15 are the throttle openings 18, which largely determine the size of the gas volume flow. When the cover is removed upward, all the plates 12 to 16 are present in the cover 30.

Also shown is the arrangement for actuating the shutoff valve 40 (not shown in this figure). It comprises a first slide element 41, which is fastened to the actuation pin 31. The first slide element 41 is in contact with a second slide element 42, which is coupled by way of a connecting element 45 to a valve body of the shutoff valve. Both slide elements 41, 42 are formed by conical bodies. A third conical body 43 serves as part of a coupling apparatus 26, which transfers a rotational movement of the actuation pin 31 to the actuation apparatus 25. The coupling apparatus 26 consists essentially of a carrier 27, which engages in a slot-type recess 28.

Figure 5:
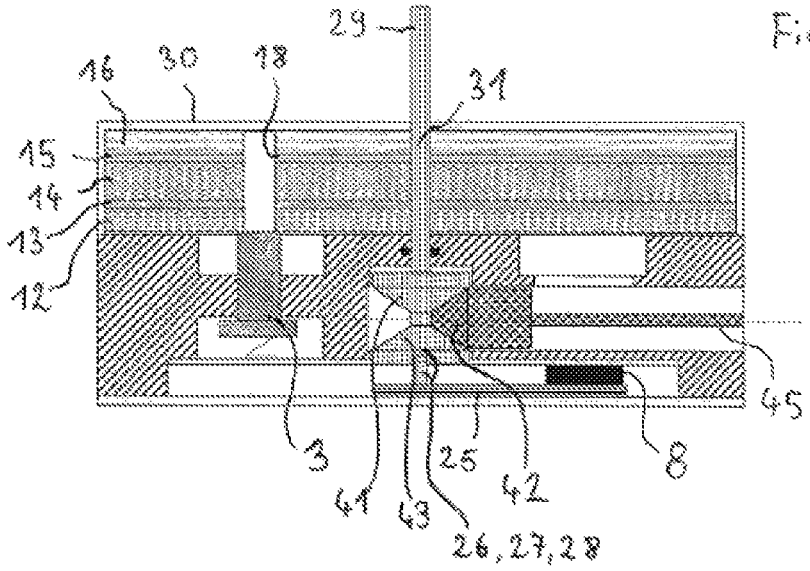
FIG. 5 shows the schematic structure of the inventive gas valve unit in the closed state.

In the position illustrated in FIG. 5 the gas valve unit is in the completely closed position. The rotation position of the actuation pin 31 is selected so that the permanent magnet 8 is not below an on-off valve 3 and therefore all the on-off valves 3 are closed. The actuation pin 31 is also not pushed in axially. The second slide element 42 is in a left stop position. The conical body shape of the first slide element 41 means that an exclusively rotational movement of the actuation pin 31 and therefore of the first slide element 41 has no influence on the position of the second slide element 42. The lower end of the actuation pin 31 is also formed by a (third) conical body 43 for the same reason.

In the switching position according to FIG. 5 there is no gas present in the valve housing 20 of the gas valve unit due to the closed shutoff valve 40.

If the switching pin 31 is now pressed in downward in an axial direction, the shutoff valve 40 opens and the valve housing 20 fills with gas.

Figure 6:
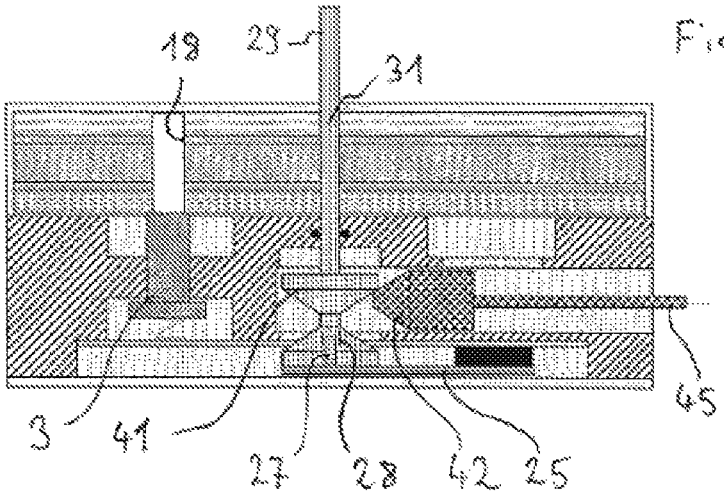
FIG. 6 shows the gas valve unit with the shutoff valve opened.

This state of the gas valve unit is illustrated in FIG. 6. The first slide element 41 here has pushed the second slide element 42 with the connecting element 45 to the right in the drawing. The connecting element 45 acts directly on the shutoff element 44 of the shutoff valve 40 (see FIG. 10) so this is opened. The lower region of the gas valve unit in the drawing is therefore filled with gas (see dotted areas). The on-off valves 3 in contrast remain closed, so the throughflow cross section of the gas valve unit continues to be zero.

FIG. 6 also shows the configuration of the coupling apparatus 26 with the flat carrier 27, which is inserted into the slot-type recess 28 in the third conical body 43. Axial movement of the actuation pin 31 can be compensated for by this combination of carrier 27 and recess 28, so such a movement is not transferred to the actuation apparatus 25 of the on-off valves 3.

Figure 7:
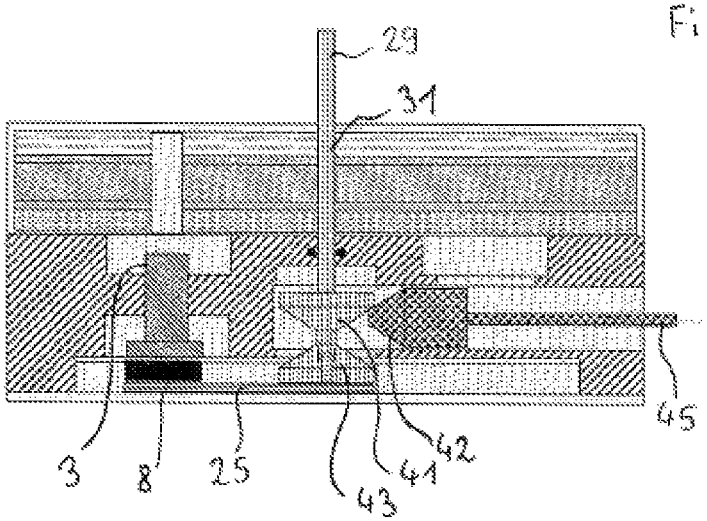
FIG. 7 shows the gas valve unit with the shutoff valve opened and the on-off valve opened.

FIG. 7 shows a further operating position of the gas valve unit, in which the shutoff valve 40 is opened by pushing in the actuation pin 31 and one of the on-off valves 3 is also opened by means of the permanent magnet 8. Gas now also flows through this opened on-off valve 3 into the region above the on-off valve in the direction of the gas outlet 2. As a result the shutoff valve 40 is held mechanically in the open position by way of the first slide element 41, the second slide element 42 and the connecting element 45.

Figure 8:
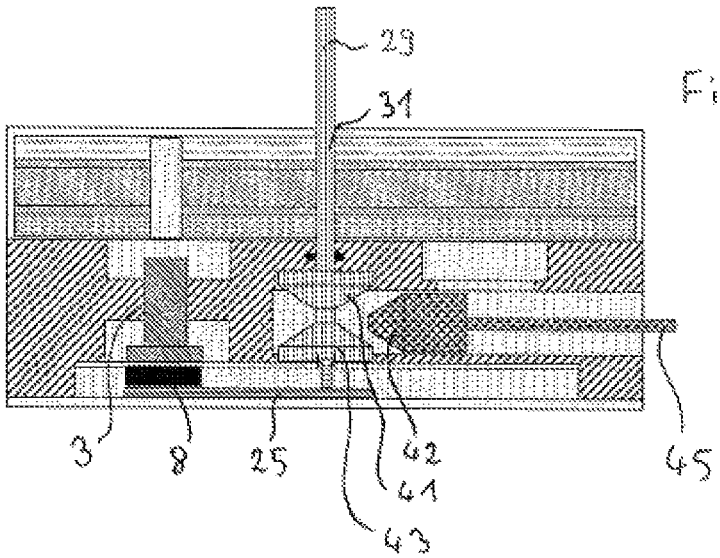
FIG. 8 shows the opened gas valve unit when the actuation pin has not been pushed.

In contrast FIG. 8 shows an operating position of the gas valve unit, in which the shutoff element 44 of the shutoff valve 40 is held in the open position by means of the force of an electromagnet (not shown in the present figure). The actuation pin 32 here is not pushed in, so the first slide element 41 does not apply force to the second slide element 42. The gas valve unit is in this position during ongoing operation, when a flame burns at the gas burner connected to the gas valve unit.

The inventive apparatus for actuating the shutoff valve 40 is described in more detail below with reference to FIGS. 9, 10 and 11. These all show the first slide element 41, the second slide element 42, a connecting element 45 formed by a spring, the shutoff element 44 and a magnetic unit 50. The closed rest position of the shutoff valve 40 is ensured by the closing spring 51 acting on the shutoff body 10. The right side of the second slide element 42 in the drawing is connected to the connecting element 45.

The connecting element 45 is bent continuously from spring wire. It has a segment 45*a* aligned parallel to the movement direction of the connecting element 45. In this segment 45*a* the connecting element 45 has no spring action. In a segment wound in a helical manner the spring wire has the function of a spring 45*b*. The spring 45*b* has a winding radius that varies in the longitudinal direction of the spring 45*b*. This allows the spring 45*b* to compress without adjacent windings of the spring 45*b* abutting against one another, rubbing against one another or hooking onto one another. The region 45*c* with the maximum winding radius of the spring 45*b* abuts in a radial direction against the housing of the shutoff valve 40. Together with the second slide element 42, which also abuts in a radial direction against the housing of the shutoff valve 40, the region 45*c* of the spring 45*b* defines the possible movement direction of the connecting element 40.

Figure 9:
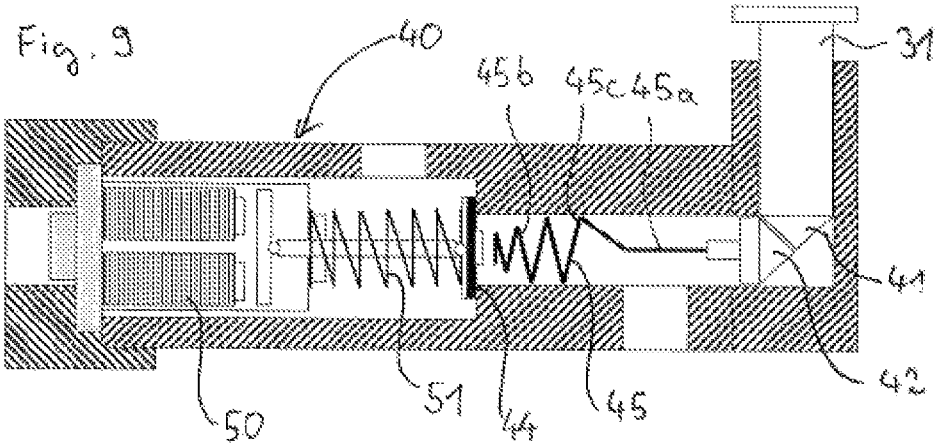
FIG. 9 shows the shutoff valve in the closed state.

In the illustration according to FIG. 9 the actuation pin is not pushed in. The shutoff valve 40 is closed by the force of the closing spring 51. The connecting element 45 is at a distance from the shutoff body 10.

Figure 10:
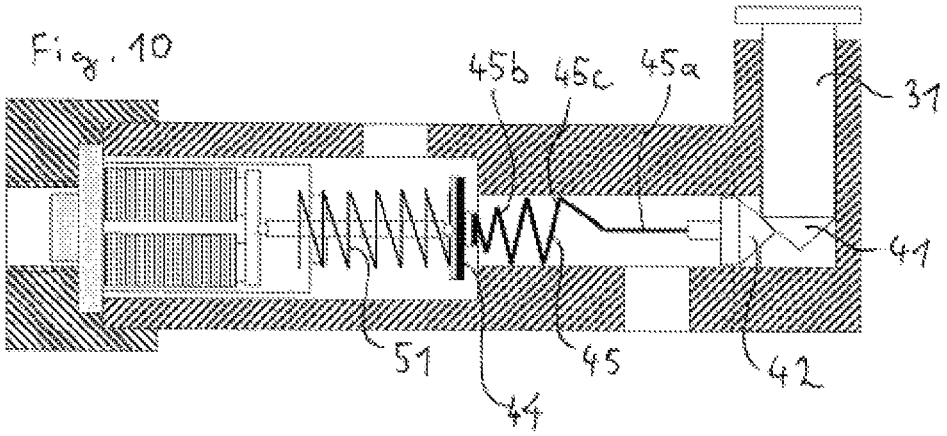
FIG. 10 shows the shutoff valve opened.

In the switching position according to FIG. 10 the actuation pin 31 is pushed in, so that the second slide element 42 with the connecting element 45 is displaced to the left in the drawing and the shutoff element 44 rises from its valve seat counter to the force of the closing spring 51. This allows gas to flow through the shutoff valve 40.

Figure 11:
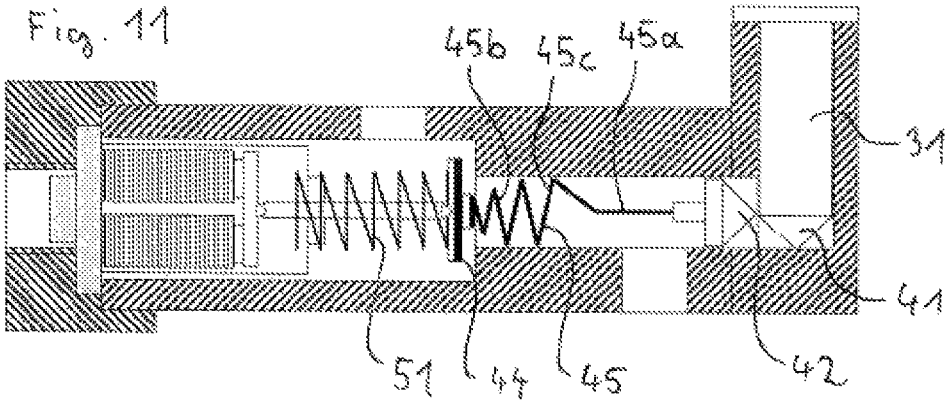
FIG. 11 shows the opened shutoff valve with the actuation pin pushed some distance.

In the illustration according to FIG. 11 the actuation pin 31 is also pushed in but further than in the position according to FIG. 10. The second slide element 42 is therefore also displaced further to the left in the drawing than in FIG. 10. So that this further movement of the second slide element 42 is not transferred to the shutoff element 44 of the shutoff valve 40, the connecting element 45 is embodied as a spring. The spring 45*b* forming the connecting element 45 is however much more rigid than the closing spring 51 of the shutoff valve 40. The configuration of the connecting element 45 as a spring 45*b* serves in particular to prevent damage to the shutoff valve 40, when the actuation pin 31 is pushed with excessive force.

Figure 12:
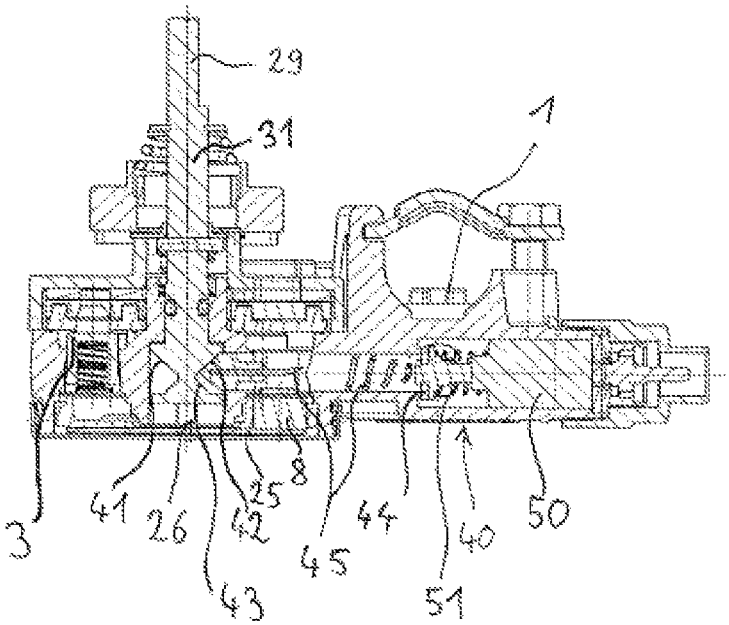
FIG. 12 shows a sectional view of the gas valve unit.

FIG. 12 shows an inventive gas valve unit in cross section. It shows the gas inlet 1, which opens directly into the shutoff valve 40. In particular the shutoff body 10, the closing spring 51 and the magnetic unit 50 of the shutoff valve 40 are clearly shown.

The connecting element 45 configured as a spring 45*b* is suitable for transferring a pressure force of the second slide element 42 to the shutoff body 10. In this process the second slide element 42 slides down along the first slide element 41, which is configured from the actuation pin 31.

Present below the first slide element 41 is the third conical element 43 with the coupling apparatus 26, which transfers a rotational movement of the actuation pin 31 to the permanent magnet 8. The magnetic force of the permanent magnet 8 opens the on-off valve 3 directly above it in each instance.

The invention claimed is:

1. A gas valve unit for setting a gas volume flow supplied to a gas burner of a gas appliance, said gas valve unit comprising:

a valve housing;

an actuation pin for setting an opening cross section of the gas valve unit;

a shutoff valve; and a linearly displaceable connecting element for transferring a movement of the actuation pin to the shutoff valve, said connecting element having a spring portion that is a coil spring having a winding radius that varies in a longitudinal direction of the spring portion, the longitudinal direction of the spring portion being along a direction of the linear displacement of the connecting element, wherein a part of the spring portion that has a maximum winding radius of all windings of the spring portion abuts the valve housing in a radial direction.

2. The gas valve unit of claim 1, constructed for setting the gas volume flow supplied to the gas burner of a gas cooker.

3. The gas valve unit of claim 1, wherein the connecting element is constructed for transferring a pressure force.

4. The gas valve unit of claim 1, further comprising a closing spring, said shutoff valve including a shutoff element which is maintained under tension by the closing spring to seek a closed position.

5. The gas valve unit of claim 4, wherein the spring portion of the connecting element has a spring constant which is greater than a spring constant of the closing spring.

6. The gas valve unit of claim 1, further comprising a deflection apparatus to convert an axial movement of the actuation pin to an axial movement of the connecting element essentially at a right angle thereto.

7. The gas valve unit of claim 6, wherein the deflection apparatus has an operating segment and a first slide element, said slide element being disposed on the actuation pin in a region of an end of the actuation pin opposite to the operating segment.

8. The gas valve unit of claim 7, wherein the deflection apparatus has a second slide element, which is in contact with the first slide element at least when the actuation pin is pushed.

9. The gas valve unit of claim 8, wherein the second slide element is disposed at an end of the connecting element facing the actuation pin.

10. The gas valve unit of claim 1, wherein the connecting element includes a spring wire having at least one straight segment which is aligned parallel to a movement direction of the connecting element.

11. The gas valve unit of claim 8, wherein the connecting element includes a spring wire having at least one straight segment which is aligned parallel to a movement direction of the connecting element, said second slide element being attached to the spring wire.

12. The gas valve unit of claim 11, wherein the second slide element is attached to the at least one straight segment of the spring wire.

13. The gas valve unit of claim 1, further comprising at least two on-off valves and at least two throttle points for setting the opening cross section, each of the throttle points having at least one throttle opening, through which gas is able flow as a function of a switching position of the on-off valves.

14. The gas valve unit of claim 12, wherein the at least one straight segment is centered radially in a passageway in the valve housing in which the connecting element is contained.

15. The gas valve unit of claim 11, wherein the at least one straight segment is centered radially in a passageway in the valve housing in which the connecting element is contained.

16. The gas valve unit of claim 10, wherein the at least one straight segment is centered radially in a passageway in the valve housing in which the connecting element is contained.

* * * * *